US005138961A

United States Patent [19]

Nakano et al.

[11] Patent Number: 5,138,961

[45] Date of Patent: Aug. 18, 1992

[54] THREAD SUPPLY DEVICE USED IN A SEWING APPARATUS WITH A PLURALITY OF NEEDLES

[75] Inventors: Minoru Nakano; Takayuki Matsunami, both of Osaka, Japan

[73] Assignee: Pegasus Sewing Machine Mfg., Co., Ltd., Osaka, Japan

[21] Appl. No.: 707,750

[22] Filed: May 30, 1991

[30] Foreign Application Priority Data

May 31, 1990 [JP] Japan ..... 2-143680

[51] Int. Cl.[5] ..... D05B 27/14; D05B 65/02

[52] U.S. Cl. ..... 112/291; 112/163; 112/255; 112/302

[58] Field of Search ..... 112/291, 292, 293, 294, 112/295, 296, 297, 298, 300, 302, 255, 278, 163, 164, 165, 166, 167

[56] References Cited

U.S. PATENT DOCUMENTS 4,215,641 8/1980 Dobrjanskyj et al. ..... 112/302 X
4,461,229 7/1984 Angele et al. ..... 112/291
4,879,960 11/1989 Prais ..... 112/291
4,932,346 6/1990 Matsubara et al. ..... 112/302 X
5,010,834 4/1991 Iimuro et al. ..... 112/278

*Primary Examiner*—Peter Nerbun
*Attorney, Agent, or Firm*—Wegner, Cantor, Mueller and Player

[57] ABSTRACT

In a thread supply device used in a sewing apparatus having a plurality of needles and a looper mechanism, needle threads guided to the needles and a looper thread guided to the looper are cut by a thread cutting unit at a cutting position, which is off a thread supply path, after a sewing operation is finished but before the following sewing operation starts. The thread supply device comprises a supply mechanism, a stopping mechanism, a memory and a control unit. The supply mechanism forcibly supplies the needle threads and the looper thread. The stopping mechanism stops the threads from being supplied. The memory stores an extra length of each thread, which is required for a cutting operation. The control unit reads out the extra length from the memory and controls the supply mechanism and the stopping mechanism so that each thread is supplied in the extra length.

13 Claims, 9 Drawing Sheets

| Number of needles | T1 | T2 | T3 | T4 | |
|---|---|---|---|---|---|
| 2 | B1 | B2 | — | B3 | B4 |
| 3 | A1 | A2 | A3 | A4 | A5 |

THREAD SUPPLY DEVICE USED IN A SEWING APPARATUS WITH A PLURALITY OF NEEDLES

BACKGROUND OF THE INVENTION (1) Field of the Invention

This invention relates to a thread supply device used in a sewing apparatus having a plurality of needles and at least one looper, in which needle threads guided to the needles and a looper thread guided to the looper are cut by a thread cutting unit at a cutting position, which is off a thread supply path, after a sewing operation is finished but before the following sewing operation starts.

(2) Description of the Prior Art

In a known sewing apparatus with a plurality of needles and a looper, needle threads and a looper thread are each inserted between two discs of a thread tension adjusting unit, whereby lengths of the threads to supply are adjusted. After a sewing operation, the threads are cut by a cutting unit.

For cutting a thread as above, the thread should be pulled to a cutting position which is off a thread supply path, which requires an extra length of the thread. In order to supply the extra length, Japanese Patent Publication Kokai No. 51-30047 discloses a sewing apparatus equipped with a thread feeding unit having a thread hook for each thread. As shown in FIG. 1, such thread feeding unit comprises a thread hook 101 and two thread guides 102 and 103. The thread hook 101 is pulled down in a direction of the arrow in a desired distance, whereby forcibly saving the thread 100 in a length required for a cutting operation. Then, the thread 100 is moved in a direction which is substantially perpendicular to a thread supply path and cut by a cutting unit.

The thread feeding unit of FIG. 1 works if the thread 100 is not loose before being pulled by the thread hook 101. If the thread is loose as shown with a dashed line in FIG. 1, pulling the hook 101 only makes the thread 100 taut and the thread 100 is cut in an insufficient length. As a result, the thread comes off from a thread hole of the needle or the insufficient length of thread contracts a final portion of the sewing medium so as to give the sewing product a poor appearance.

When the next sewing operation starts, the looper starts working in association with a main shaft of the sewing apparatus. If a looper thread is insufficient in length, the looper thread comes off from the looper, which unables the sewing operation. To solve this problem, the looper thread is supplied extra for the cutting operation. Such a process leads to another problem that the looper thread gets loose in the middle after being cut and caught by the thread guide or the like to be cut erroneously.

SUMMARY OF THE INVENTION

Accordingly, this invention has an object of offering a thread supply device used in a sewing apparatus with a plurality of needles for supplying needle threads in appropriate lengths with no insufficiency for a cutting operation.

This invention has another object of offering a thread supply device used in a sewing apparatus with a plurality of needles and a looper for preventing the looper thread from coming off from the looper to be cut erroneously when the following sewing operation starts.

In accordance with the features of the present invention, there is provided a thread supply device used in a sewing apparatus having a plurality of needles and at least one looper, in which needle threads guided to the needles and a looper thread guided to the looper are cut by a thread cutting unit at a cutting position, which is off a thread supply path, after a sewing operation is finished but before the following sewing operation starts. A supply mechanism forcibly supplies the needle threads. A stopping mechanism stops the needle threads from being supplied. A memory stores a predetermined length of each needle thread, which is required for a cutting operation. A control unit reads out the predetermined length from the memory and controls the supply mechanism and the stopping mechanism so that each needle thread is supplied in the predetermined length.

The supply mechanism may comprise at least a pair of rollers for holding the needle threads and a motor for driving the rollers to feed the needle threads at a circumferential speed of the rollers.

The motor may have a rotary encoder for detecting a rotating amount of the motor and outputting the rotating amount as pulses, a number of which indicates the predetermined length stored in the memory.

The stopping mechanism may comprise thread holding units respectively provided for the needle threads in an upstream portion from the supply mechanism in the thread supply path. Each thread holding unit comprises an electromagnetic solenoid and a holding member for holding the thread between the electromagnetic solenoid and the holding member by use of a magnetic force generated by electrifying the electromagnetic solenoid.

The predetermined length of each thread stored in the memory may be obtained from a distance between the needle corresponding to each needle thread and the cutting position of the thread cutting unit. The thread cutting unit is provided on a line which is substantially extended from a line which connects tips of the needles, the distance being different thread by thread.

The thread supply device may further comprise a detector for detecting that a sewing operation is finished, wherein the control unit comprises a first section and a second section. The first section controls each thread holding unit to release the corresponding thread when the detector detects that the sewing operation is finished. When the number of the pulses from the rotary encoder of the motor corresponds with the predetermined length of each needle thread stored in the memory, the second section controls the thread holding unit to hold the corresponding thread.

The control unit may further comprise a third section for controlling the thread cutting unit to cut the threads when all the thread holding units hold the threads.

Also in accordance with the features of the present invention, a supply mechanism forcibly supplies a plurality of needle threads and a looper thread. A stopping mechanism stops the threads from being supplied by holding the threads. A memory stores a first predetermined length of each thread, which is required for a cutting operation, and a second predetermined length of the looper thread, which is required to prevent the looper thread from coming off from the looper when the following sewing operation starts. A control unit reads out the first predetermined length of each thread and the second predetermined length from the memory, controls the supply mechanism and the stopping mechanism so that each thread is supplied in the first predetermined length, controls the thread cutting unit to cut the threads, and then controls the supply mechanism and the stopping mechanism so that the looper thread is supplied in the second predetermined length.

According to the above construction, after a sewing operation is finished, the predetermined length of each thread which is required for the cutting operation is supplied beforehand. Since the thread is supplied through the cooperation of the supply mechanism and the stopping mechanism both controlled by the control unit, the thread is supplied accurately in the predetermined length with no insufficiency even if the thread is loosened. After the cutting operation, the predetermined length of the looper thread which is required for the beginning of the following sewing operation is supplied through the cooperation of the supply mechanism and the stopping mechanism. As a result, the looper thread does not come off from the looper when the following sewing operation starts.

BRIEF DESCRIPTION OF THE DRAWING

These and other objects, advantages and features of the invention will become apparent from the following description thereof taken in conjunction with the accompanying drawings which illustrate a specific embodiment of the invention. In the drawings.

DESCRIPTION OF A PREFERRED EMBODIMENT

An embodiment of this invention will be described referring to figures.

Figure 1:
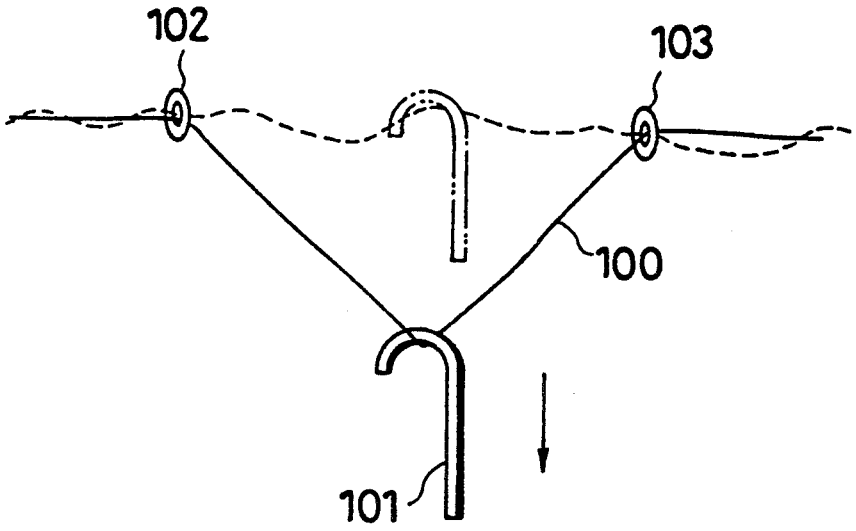
Fig. 1 Prior Art
FIG. 1 is a view showing how a thread is supplied conventionally.
Figure 2:
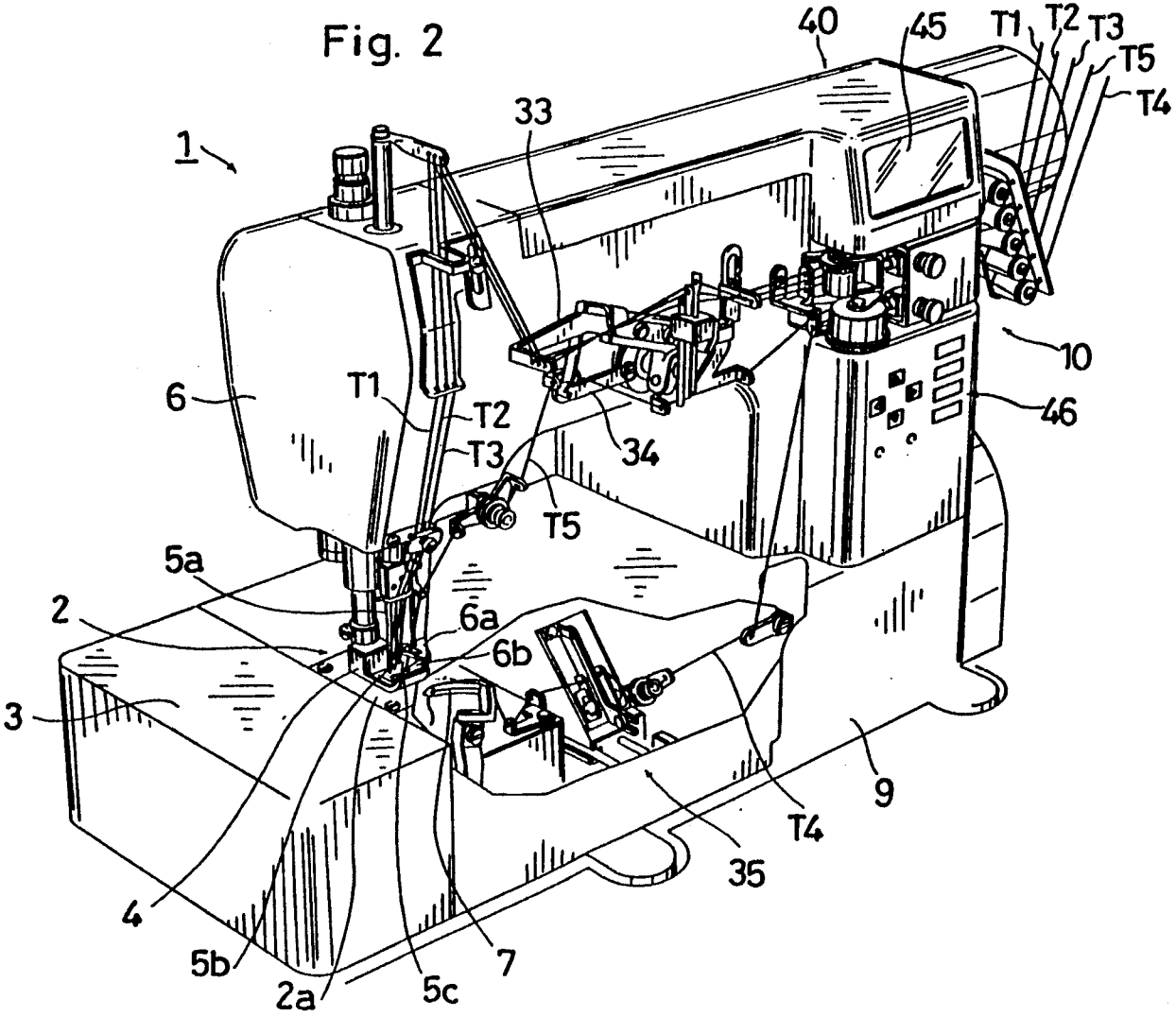
FIG. 2 is a perspective view of a sewing apparatus 1 equipped with a thread supply device 10 according to this invention.

In FIG. 2, 1 refers to a sewing apparatus with a plurality of needles. The sewing apparatus 1 includes a well-known sewing mechanism driven in accordance with a rotation of a main shaft (not shown). The sewing mechanism comprises a transporting section 2 for retaining a cloth as a sewing medium and transporting the cloth at a specified pitch, the section 2 including a needle plate 2*a*, a cloth table 3 on which the cloth is placed, a pressing member 4 for pressing the cloth on the table 3 by a specified force, an arm 6 having a plurality of needles (three needles 5*a*, 5*b* and 5*c* in this embodiment), and a looper 7 provided below the needles 5*a* through 5*c*. The sewing apparatus 1 further comprises a thread supply device 10 for supplying needle threads T1 through T3, a looper thread T4 and a cover thread T5 in lengths required for each stitch and also in lengths required for a cutting operation, a frame 9 having the table 3, the arm 6 and the device 10 at optimal positions and accommodating various parts, and a control section 40 built in a right section (FIG. 2) of the frame 9.

Figure 3:
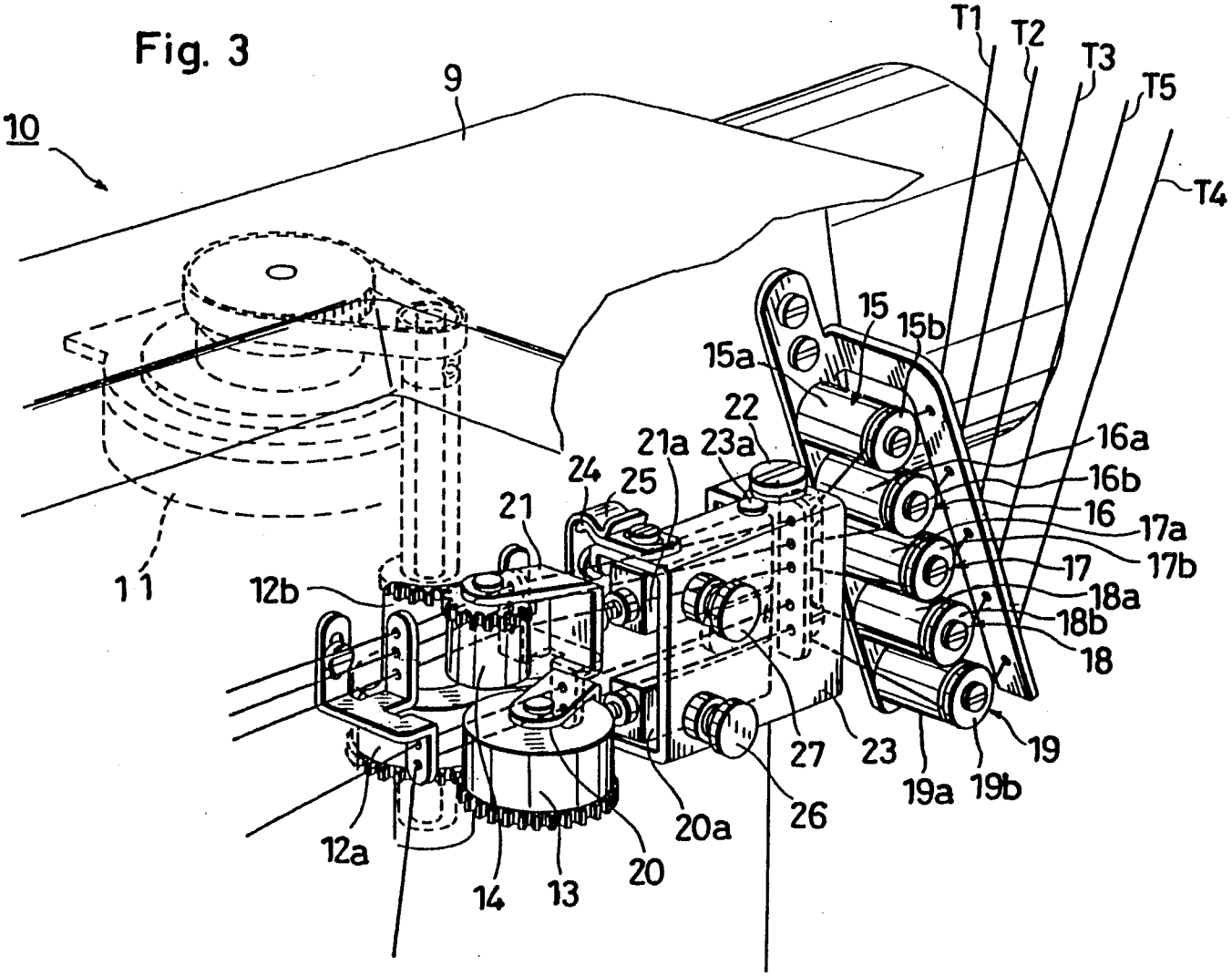
FIG. 3 is a perspective view of the thread supply device 10.

As shown in FIG. 3, the thread supply device 10 comprises a pair of large and small driving rollers 12*a* and 12*b*, a pair of large and small subordinate rollers 13 and 14, and five thread holding solenoids 15 through 19. The rollers 12*a*, 12*b*, 13 and 14 each have a gear portion. The large driving roller 12*a* and the large subordinate roller 13 are geared with each other through the gear portions thereof, and the small driving roller 12*b* and the small subordinate roller 14 are geared with each other through the gear portions thereof.

The rollers 13 and 14 are respectively supported at both ends thereof by bearing members 20 and 21. The bearing members 20 and 21 respectively have base portions 20*a* and 21*a*, which are accommodated in a holder 23 and fixed to a shaft 23*a*. The holder 23 is pivotal around a shaft 22 within a certain angle, and the shaft 23*a* is rotatably supported by the holder 23. When an engaging member 24 attached to the holder 23 is engaged with another engaging member 25 fixed on the frame 9, the rollers 13 and 14 goes into a thread supply mode as will be explained in detail, hereinafter.

Figure 4:
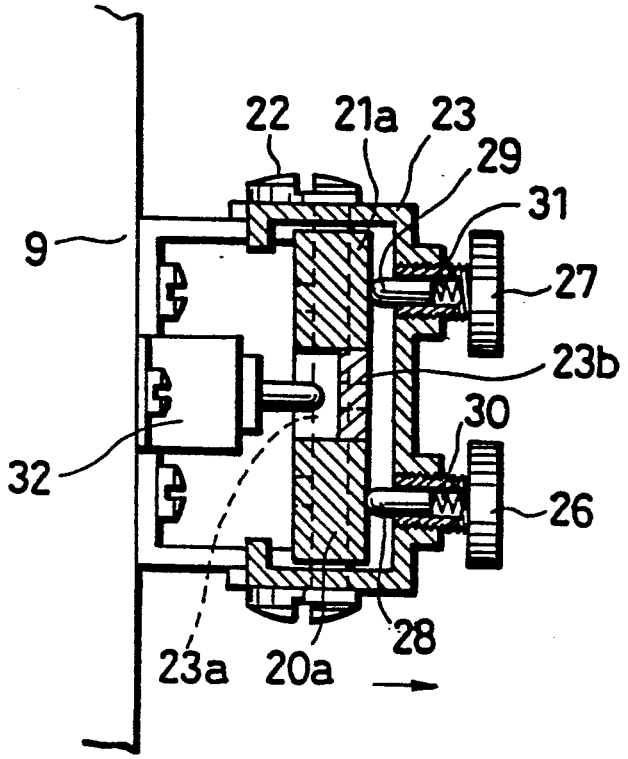
FIG. 4 is a partial cross sectional view of the thread supply device 10.

As shown in FIG. 4, springs 30 and 31 are respectively defined by screws 26 and 27 inserted into the holder 23 and by pieces 28 and 29 respectively in contact with the base portions 20*a* and 21*a*. The bearing members 20 and 21 are pressed by the springs 30 and 31 through the base portions 20*a* and 21*a*, whereby the rollers 13 and 14 are pressed on the rollers 12*a* and 12*b*.

The thread supply device 10 further comprises a latch solenoid 32 provided on the frame 9 and a releasing plate 23*b* fixed to the shaft 23. If no more thread supply is required, the latch 32 is driven to push the releasing plate 23*b* in a direction of the arrow. Then, the shaft 23*a* is pivoted, and thus the bearing members 20 and 21 are pivoted, whereby separating the rollers 13 and 14 from the rollers 12*a* and 12*b*.

As shown in FIG. 3 again, the solenoids 15, 16, 17, 18 and 19 are respectively for holding the threads T1, T2, T3, T5 and T4 to forcibly stop the threads from running toward the rollers 12*a* and 12*b*. The solenoids 15 through 19 respectively comprise main bodies 15*a* through 19*a* and pressing plates 15*b* through 19*b* attached on tips of shafts of the main bodies 15*a* through 19*a*. When the solenoids 15 through 19 are electrified, the pressing plates 15*b* through 19*b* approach the main bodies 15*a* through 19*a*, whereby holding the threads therebetween. When the solenoids 15 through 19 are de-electrified, the pressing plates 15*b* through 19*b* separate from the main bodies 15*a* through 19*a*, whereby releasing the threads. Each solenoid has a holding force which is stronger than a thread transporting force of the roller 12*a* or 12*b*. The electrifying and de-electrifying timing is controlled by the control section 40.

The needle threads T1, T2 and T3 which have passed by the solenoids 15 through 17 run between the roller 12*b* and 14 and are carried to the needles 5*a*, 5*b* and 5*c* through a thread takeup member 33 and the like. The cover thread T5 which has passed by the solenoid 18 runs between the rollers 12*a* and 13 and is carried to a fixed guide 6a through another thread takeup member 34 and the like, the fixed guide 6a being provided above a spreader 6b. The looper thread T4 which has passed by the solenoid 19 runs between the rollers 12a and 13 and is carried to the looper 7 through a thread saving unit 35 and the like.

Figure 5A:
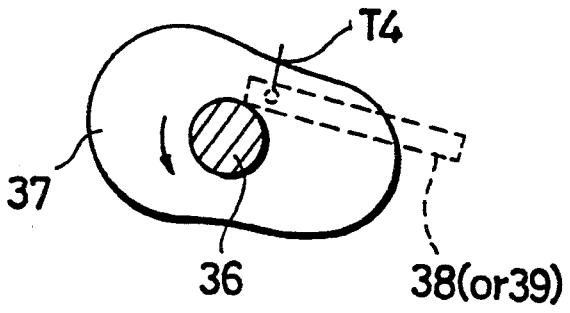
FIG. 5*a* is a cross sectional view of a thread saving unit 35.
Figure 5B:
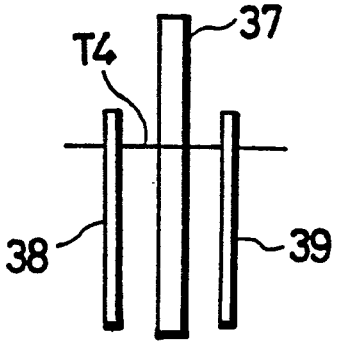
FIG. 5*b* is a plan view of the thread saving unit 35.

As shown in FIGS. 5a and 5b, the thread saving unit 35 comprises a shaft 36 which is rotated in a direction of the arrow in association with the main shaft of the sewing apparatus 1, a cam fixed around the shaft 36, and thread guiding members 38 and 39 interposing the cam 37. When the cam 37 is rotated by the rotation of the shaft 36 (FIG. 5a), the looper thread T4 guided by the thread guiding members 38 and 39 is made into a V shape at a position where the radius of curvature of the cam 37 is large. In this way, the looper thread T4 is fed.

Figure 6:
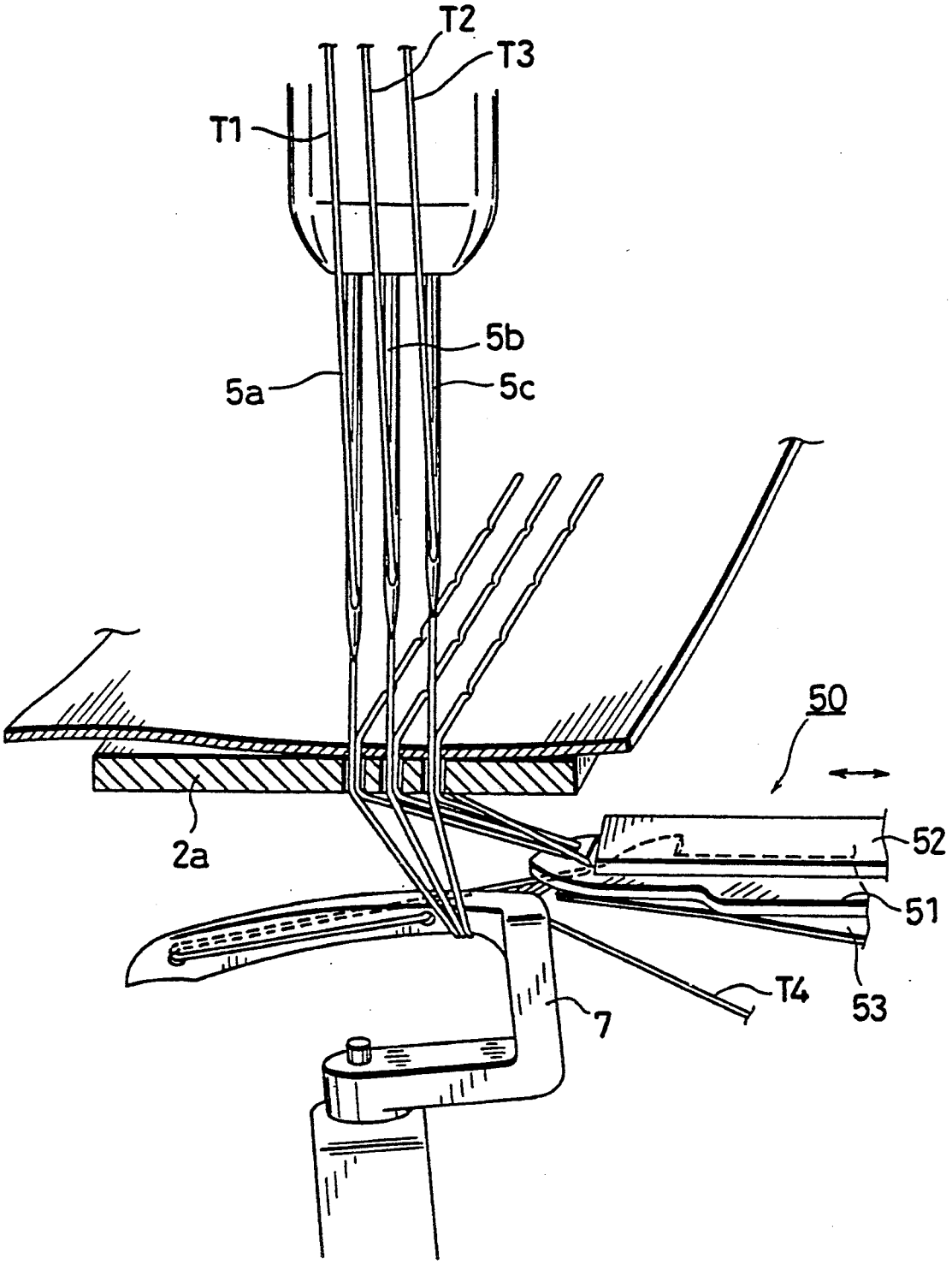
FIG. 6 is a perspective view of a thread cutting unit 50 and a vicinity thereof.

FIG. 6 shows a thread cutting unit 50 for cutting the threads T1 through T4. The thread cutting unit 50 comprises a movable cutter 51, a fixed cutter 52 provided above the movable cutter 51, and a flat spring 53 provided below the movable cutter 51. The movable cutter 51 is moved as shown with the arrow, namely, substantially perpendicularly to a thread supply path.

The threads T1 through T4 are pulled by a hooked blade portion of the movable cutter 51, and cut by the cooperative operation of the movable cutter 51 and the fixed cutter 52 while being retained between the movable cutter 51 and the flat spring 53.

Figure 7:
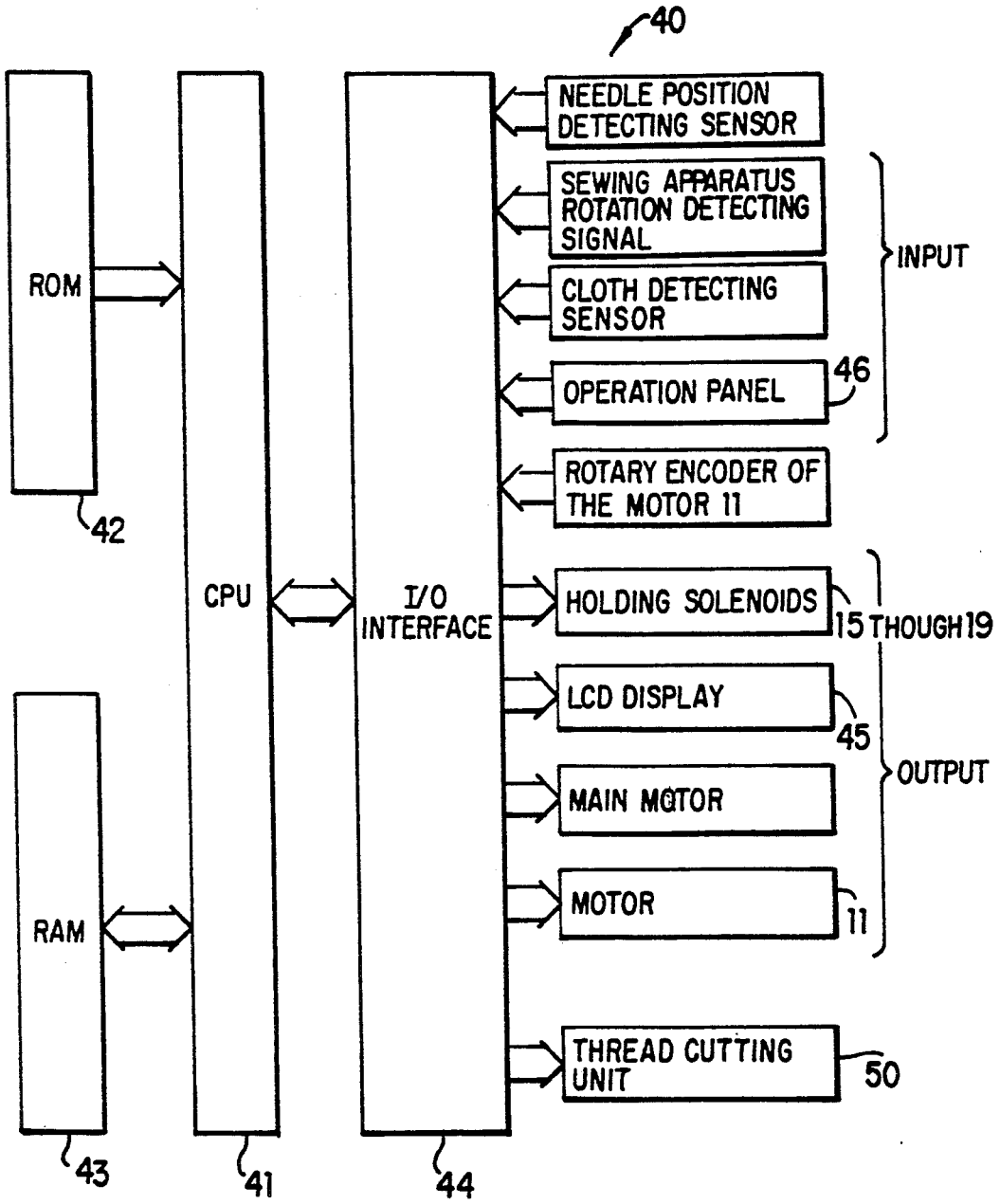
FIG. 7 is a block diagram of a control section 40 of the sewing apparatus 1.

FIG. 7 is a block diagram of the control section 40. The control section 40 comprises a CPU 41, a ROM 42, a RAM 43, an LCD display 45 and an operation panel 46 having a plurality of keys (FIG. 2) for inputting and reading out data to and from the RAM 43.

Inputted to the CPU 41 through an I/O interface 44 are a signal indicating the rotating amount of the motor 11 equipped with the rotary encoder, a signal concerning the rotation of the main shaft, signals from the operation panel 46 and other signals. Outputted from the CPU 41 through the I/O interface 44 are signals for turning on or off the solenoids 15 through 19, signals for displaying data on the LCD display 45, a signal for turning on or off the thread cutting unit 50 and other signals.

Once a sewing operation is finished, the threads T1 through T5 are cut to prepare the sewing apparatus 1 for the following sewing operation. Such a cutting operation requires a predetermined length for each thread, which is supplied in the following way.

Figures 8, 9:
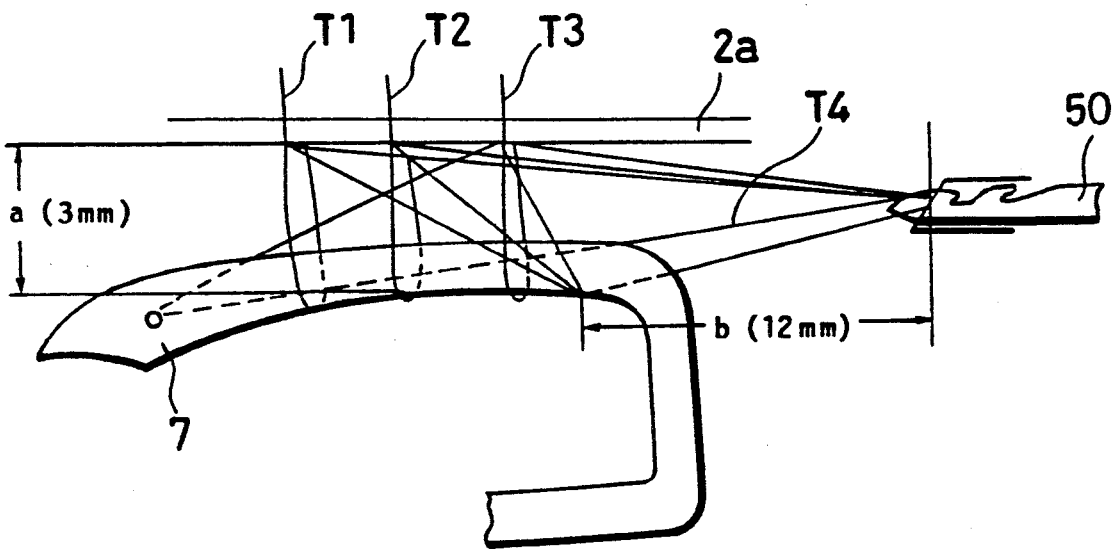
FIG. 8 is a table stored in a RAM 43.
FIGS. 9 and 10 are views explaining how a predetermined length of each thread required for a cutting operation is obtained.

FIG. 8 shows a table stored in the RAM 43. In FIG. 8, A1 signifies the predetermined length for the thread T1, A2 for the thread T2, A3 for the thread T3, and A4 and A5 for the thread T4. B1 through B4 signify the same in the sewing apparatus equipped with two needles.

A1 through A3 have different values because the threads T1 through T3 are pulled by the thread cutting unit 50 in different lengths.

Figure 10:
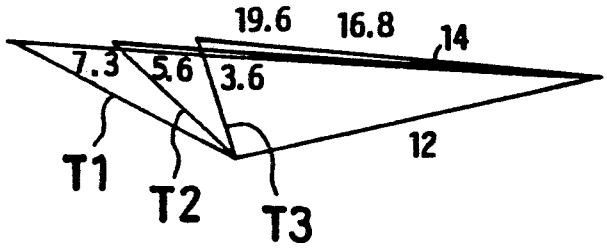

A practical explanation will follow. In FIG. 9, "a", which is a vertical distance between a bottom surface of the needle plate 2a and a bottom surface of an upper portion of the looper 7, is 3 mm. The needle plate 2a has holes through which the needles 5a through 5c are inserted. "b", which is a horizontal distance between a position of the looper 7 at which the threads T1 through T3 are gathered and a position of the thread cutting unit 50 at which the threads T1 through T4 are retained, is 12 mm. In this case, the lengths of the threads existing below the needle plate 2a are:

T1: $7.3+12+19.6=38.9$ mm
T2: $5.6+12+16.8=34.4$ mm
T3: $3.6+12+14=29.6$ mm
as shown in FIG. 10.

The above-obtained figures include a length which is already supplied when the sewing operation is finished, namely, a sum of a double of "a" (namely, 6 mm) and a thickness (2.7 mm in this case) of the looper 7, the sum being 8.7 mm. With the sum being subtracted, the lengths still required for the cutting operation are:
T1$=30.2$ mm; T2$=25.7$ mm; and T3$=20.9$ mm These lengths are stored in the RAM 43 (A1 through A3) as values corresponding to pulse numbers generated by the rotation of the motor 11.

Figure 11:
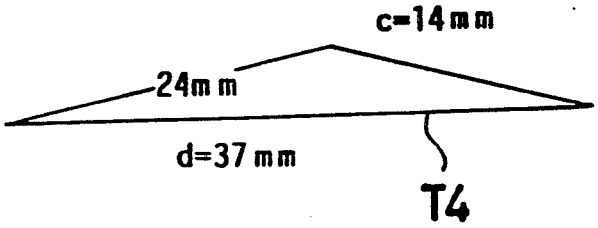
FIG. 11 and 12 are views explaining how a predetermined length of a looper thread T4 required for preventing the looper thread T4 from coming off from the looper 7 when the following operation starts is obtained.

FIG. 11 shows an example concerning the thread T4. "c", which is a distance between one of the holes of a bottom surface of the needle plate 2a through which the needle 5c is inserted and a position of the needle cutting unit 50 at which the thread T4 is retained, is 14 mm. "d", which is a distance between the above position at which the thread T4 is retained and a hole of the looper 7 (FIG. 9), is 37 mm. The length of the thread T4 existing below the needle plate 2a is $37+14=51$ mm. This value includes a length of the thread T4 which is already supplied when the sewing operation is finished, namely, 24 mm. With 24 mm being subtracted, the length still required for the cutting operation is 27 mm. Such a value is stored in the RAM 43 (A4) as a value corresponding to a pulse number generated by the rotation of the motor 11.

Figure 12:
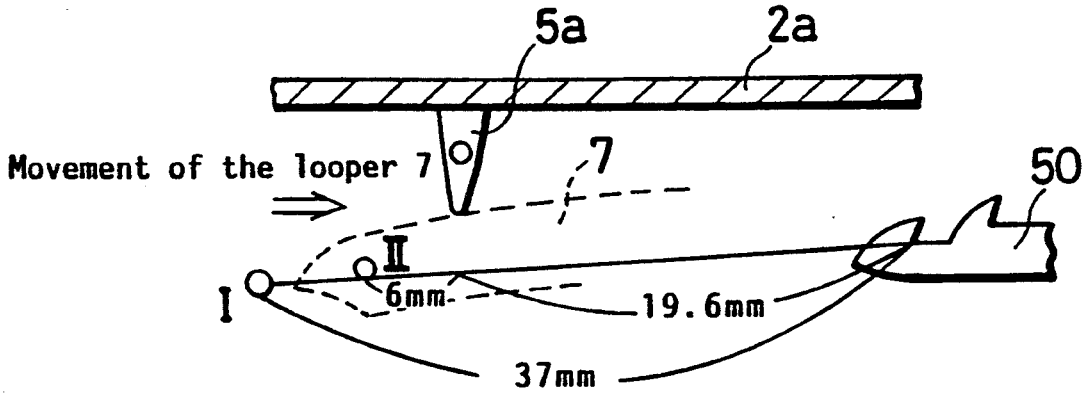

When a sewing operation is finished and the main shaft of the sewing apparatus 1 starts rotating for the following sewing operation, the looper 7 starts operating and the thread saving unit 35 starts taking in the thread T4. If the thread T4 is insufficient in length from a leading tip thereof to a point thereof retained by the thread cutting unit 50, thread T4 comes off from the looper 7. To prevent such a problem, the thread T4 should be supplied in a still extra length, which is practically obtained as shown in FIG. 12.

When the main shaft of the sewing apparatus 1 is rotated 90° from an original position (0°) thereof, the hole of the looper 7 moves from a position I to a position II. Then, a distance between the hole of the looper 7 and an intersection of a line which is perpendicularly extended from a tip of the needle 5a and a line connecting the hole of the looper 7 and the position of the cutting unit 50 at which the thread T4 is retained is shortened to 6 mm. A distance between the above intersection and the position of the thread cutting unit 50 at which the thread T4 is retained is 19.6 mm. The above 6 mm and 19.6 mm are included in "d" (37 mm). $37-(6+19.6)=11.4$ mm is a distance between the positions I and II. Since the thread T4 runs on both sides of the looper 7, the thread T4 gets excessive in $11.4\times2=22.8$ mm by the movement of the looper 7 from the positions I to II. Since the thread saving unit 35 has taken in the thread T4 in approx. 50 mm by the time the looper 7 moves to the position II, the above-mentioned still extra length is $50-22.8=27.2$ mm, which is stored as A5.

With the above data being stored in the RAM 43, the sewing apparatus 1 is prepared for the sewing operation. The relevant data are read out through the operation panel 46. The read-out data are stored in an executing section of the RAM 43 in advance or during the sewing operation of the sewing apparatus 1. When an end of a pedal (not shown) of the sewing apparatus 1, the end being farther from the operator, is pushed, the sewing operation starts. The data for obtaining length of the threads which are required for a stitch have been stored in the executing section, based on which the control section 40 controls the thread supply device 10 during the sewing operation.

Figure 13:
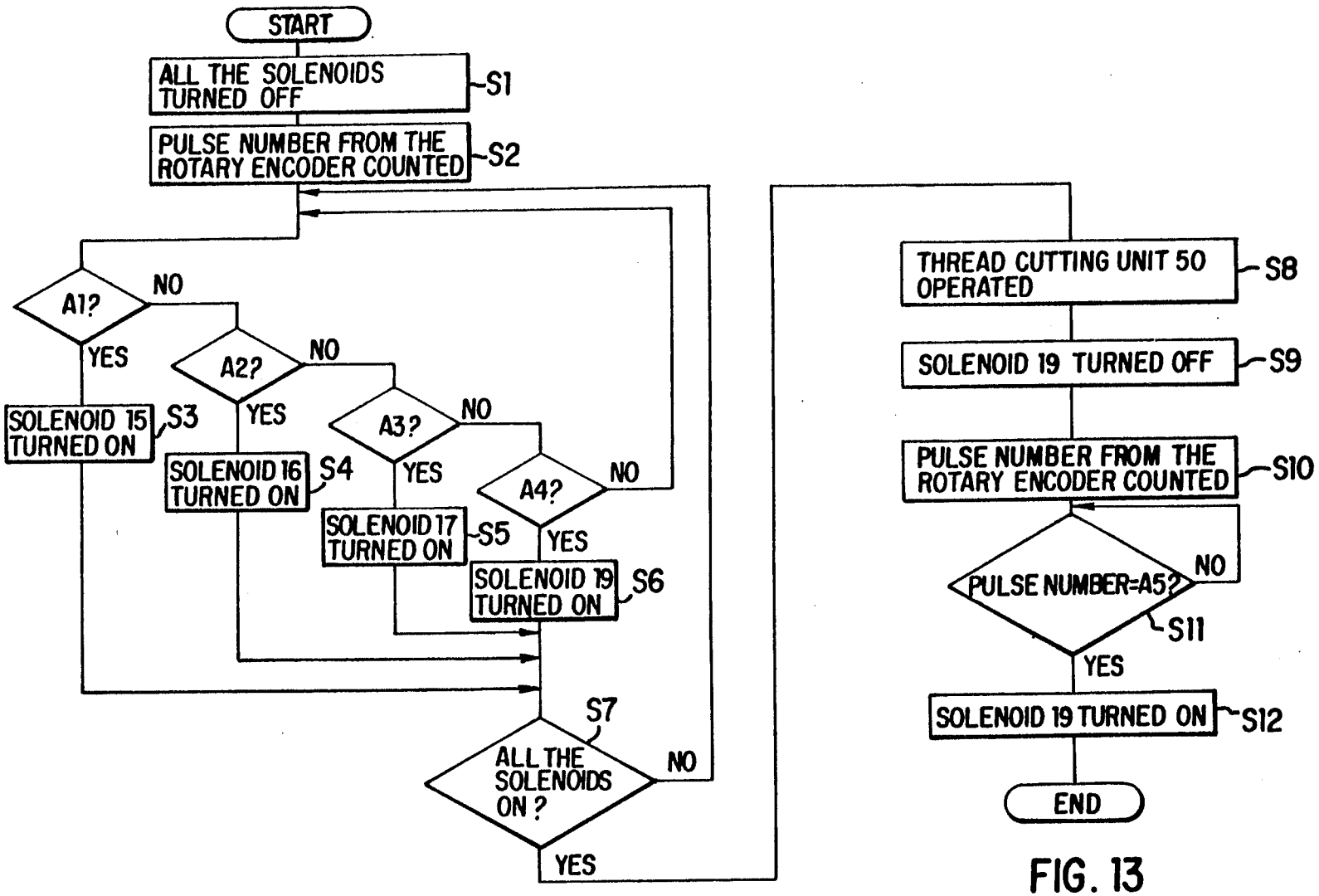
FIG. 13 is a flowchart of a thread supply control of the control section 40.

When the other end of the pedal which is closer to the operator is pushed, the sewing operation is finished. The main shaft is controlled to be at the original position when the sewing operation is finished. On completion of the sewing operation, the control section 40 starts a thread supply control for the cutting operation as shown in FIG. 13.

First, all the solenoids 15 through 19 are turned off (S1), whereby the threads T1 through T5 are supplied by the rotation of the rollers 12*a* and 12*b*. The pulse numbers from the rotary encoder of the motor 11 is counted (S2). If the counted value corresponds to A1, A2, A3 or A4, the solenoid 15, 16, 17, or 19 is turned on (S3 through S6). If the counted value corresponds to none of A1 through A4, S3 through S6 are repeated. In this way, the threads T1 through T4 are supplied in the extra lengths of A1 through A4. Owing to the thread supply device 10 for forcibly supplying or stopping the threads, the threads are supplied accurately in the above extra lengths even if the threads get loose in the vicinity of the needles 5*a* through 5*c* and the looper 7.

Whether all the solenoids 15 through 19 have been turned on or not is judged in S7. If so, the thread cutting unit 50 is operated to cut the threads T1 through T4 in S8. The thread T5 is cut by another thread cutting unit (not shown) through a command from the control section 40. Thereafter, the solenoid 19 is turned off (S9), the pulse number from the rotary encoder of the motor 11 is counted (S10), and whether the counted value corresponds to A5 or not is judged (S11). If so, it is determined that the thread T4 has been supplied extra according to A5, and the solenoid 19 is turned on (S12). If all the solenoids 15 through 19 have not been turned on in S7, or the counted number does not correspond to A5 in S12, S7 or S12 is repeated until it is judged yes.

In the above operation, the thread T4 does not come off from the looper 7 when the following sewing operation starts.

In the above embodiment, since a distance between the needles 5*a* and 5*b*, and a distance between the needles 5*b* and 5*c* are fixed, the RAM 43 stores the lengths of the threads in one combination. If the above distances are variable, the lengths of the threads are stored in a plurality of combinations, from which the relevant one is selected for each case.

Two or four needles may be provided instead of three.

Although the present invention has been fully described by way of an embodiment with references to the accompanying drawings, it is to be noted that various changes and modifications will be apparent to those skilled in the art. Therefore, unless such changes and modifications depart from the scope of the present invention, they should be construed as being included therein.

What is claimed is:

1. A thread supply device used in a sewing apparatus having a plurality of needles and a looper mechanism, in which needle threads guided to the needles and a looper thread guided to the looper mechanism are cut by a thread cutting unit at a cutting position, which is off a thread supply path, after a sewing operation is finished but before the following sewing operation starts, the thread supply device comprising:

a supply mechanism for forcibly supplying a plurality of needle threads;

a stopping mechanism for stopping the needle threads from being supplied;

memory means for storing a predetermined different length of each needle thread, which is required for a cutting operation; and control means for reading out the predetermined length different of each needle thread from said memory means and controlling said supply mechanism and said stopping mechanism so that each needle thread is supplied in a corresponding predetermined different length.

2. A thread supply device of claim 1, wherein said supply mechanism comprises at least a pair of rollers for holding the needle threads and a motor for driving the rollers to feed the needle threads at a circumferential speed of the rollers.

3. A thread supply device of claim 2, wherein the motor has a rotary encoder for detecting a rotating amount of the motor and outputting the rotating amount as pulses, a number of which indicates the predetermined length stored in said memory means.

4. A thread supply device used in a sewing apparatus having a plurality of needles and a looper mechanism, in which needle threads guided to the needles and a looper thread guided to the looper mechanism are cut by a thread cutting unit at a cutting position, which is off a thread supply path, after a sewing operation is finished but before the following sewing operation starts, the thread supply device comprising:

a supply mechanism for forcibly supplying a plurality of needle threads, said supply mechanism including at least a pair of rollers for holding the needle threads and a motor for driving the rollers to feed the needle threads at a circumferential speed of the rollers;

a stopping mechanism for stopping the needle threads from being supplied, said stopping mechanism including thread holding units respectively provided for the needle threads in an upstream portion from said supply mechanism in the thread supply path, each thread holding unit having an electromagnetic solenoid and a holding member for holding the thread between the electromagnetic solenoid and the holding member by use of a magnetic force generated by electrifying the electromagnetic solenoid;

memory means for storing a predetermined length of each needle thread, which is required for a cutting operation;

control means for reading out the predetermined length of each needle thread from said memory means and controlling said supply mechanism and said stopping mechanism so that each needle thread is supplied in a corresponding predetermined length; and wherein the motor has a rotary encoder for detecting a rotating amount of the motor and outputting the rotating amount as pulses, a number of which indicates a corresponding predetermined length stored in said memory means.

5. A thread supply device of claim 4, wherein the predetermined length of each needle thread stored in said memory means is obtained from a distance between the needle corresponding to each needle thread and the cutting position of the thread cutting unit provided on a line which is substantially extended from a line which connects tips of the needles, the distance being different needle thread by needle thread.

6. A thread supply device of claim 5, further comprising detecting means for detecting that the sewing operation is finished, wherein said control means comprises a first section for controlling each thread holding unit to release the corresponding needle thread when the detecting means detects that the sewing operation is finished and a second section for, when the number of the pulses from the rotary encoder of the motor corresponds with the predetermined length of each needle thread stored in said memory means, controlling the thread holding unit to hold the corresponding needle thread.

7. A thread supply device of claim 6, wherein said control means further comprises a third section for controlling the thread cutting unit to cut the needle threads when all the thread holding units hold the needle threads.

8. A thread supply device used in a sewing apparatus having a plurality of needles and a looper mechanism, in which needle threads guided to the needles and a looper thread guided to the looper mechanism are cut by a thread cutting unit at a cutting position, which is off a thread supply path, after a sewing operation is finished but before the following sewing operation starts, the thread supply device comprising:

a supply mechanism for forcibly supplying a plurality of needle threads and a looper thread;

a stopping mechanism for stopping the threads from being supplied by holding the threads;

memory means for storing a first predetermined length of each needle and looper thread individually, which is required for a cutting operation, and a second predetermined length of the looper thread, which is required to prevent the looper thread from coming off from the looper mechanism when the following sewing operation starts; and control means for reading out the first predetermined length of each thread and the second predetermined length from said memory means, for controlling said supply mechanism and said stopping mechanism so that each thread is supplied in the first predetermined length, for controlling the thread cutting unit to cut the threads, and then for controlling said supply mechanism and said stopping mechanism so that the looper thread is supplied in the second predetermined length.

9. A thread supply device of claim 8, wherein said supply mechanism comprises at least a pair of rollers for holding the threads and a motor for driving the rollers to feed the threads at a circumferential speed of the rollers.

10. A thread supply device of claim 9, wherein the motor has a rotary encoder for detecting a rotating amount of the motor and outputting the rotating amount as pulses, a number of which indicates the predetermined length stored in said memory means.

11. A thread supply device used in a sewing apparatus having a plurality of needles and a looper mechanism, in which needle threads guided to the needles and a looper thread guided to the looper mechanism are cut by a thread cutting unit at a cutting position, which is off a thread supply path, after a sewing operation is finished but before the following sewing operation starts, the thread supply device comprising:

a supply mechanism for forcibly supplying a plurality of needle threads and a looper thread, said supply mechanism including at least a pair of rollers for holding the needle threads and a motor for driving the rollers to feed the needle threads at a circumferential speed of the rollers;

a stopping mechanism for stopping the threads from being supplied, said stopping mechanism including thread holding units respectively provided for the needle threads in an upstream portion from said supply mechanism in the thread supply path, each thread holding unit having an electromagnetic solenoid and a holding member for holding the thread between the electromagnetic solenoid and the holding member by use of a magnetic force generated by electrifying the electromagnetic solenoid;

memory means for storing a first predetermined length of each thread, which is required for a cutting operation, and a second predetermined length of the looper thread, which is required to prevent the looper thread from coming off from the looper mechanism when the following sewing operation starts;

control means for reading out the first predetermined length of each thread and the second predetermined length from said memory means, for controlling said supply mechanism and said stopping mechanism so that each thread is supplied in the first predetermined length, for controlling the thread cutting unit to cut the threads, and then for controlling said supply mechanism and said stopping mechanism so that the looper thread is supplied in the second predetermined length; and wherein the motor has a rotary encoder for detecting a rotating amount of the motor and outputting the rotating amount as pulses, a number of which indicates a corresponding predetermined length stored in said memory means.

12. A thread supply device of claim 11, wherein the first predetermined length of each thread stored in said memory means is obtained from a distance between the needle corresponding to each thread and the cutting position of the thread cutting unit provided on a line which is substantially extended from a line which connects tips of the needles, the distance being different thread by thread.

13. A thread supply device used in a sewing apparatus having a plurality of needles and a looper mechanism, in which needle threads guided to the needles and a looper thread guided to the looper mechanism are cut by a thread cutting unit at a cutting position which is off a thread supply path after a sewing operation is finished but before the following sewing operation starts, the thread supply device comprising:

a supply mechanism for forcibly supplying a plurality of needle threads and looper thread, said supply mechanism comprising at least a pair of rollers for holding the thread and a motor for driving the rollers to feed the thread at a circumferential speed of the rollers, the motor having a rotary encoder for detecting a rotating amount of the motor and outputting the rotating amount as pulses;

a stopping mechanism for stopping the threads from being supplied by holding the threads, said stopping mechanism comprising thread holding units respectively provided for the threads in an upstream portion from said supply mechanism in the thread supply path, each thread holding unit comprising an electromagnetic solenoid and a holding member for holding the thread between the electromagnetic solenoid and the holding member by use of a magnetic force generated by electrifying the electromagnetic solenoid;

memory means for storing a first predetermined length of each thread, which is required for a cutting operation, and a second predetermined length of the looper thread, which is required to prevent the looper thread from coming off from the looper mechanism when the following sewing operation starts, the first and the second predetermined lengths each being defined by a number of pulses, the first predetermined length of each thread being different from one another;

detecting means for detecting that the sewing operation is finished;

a counter for counting the number of the pulses sent from the rotary encoder or the motor; and control means comprising a first control section for controlling the thread holding units to release the threads when said detecting means detects that the sewing operation is finished; a second control section for, when the number counted by said counter corresponds with the first predetermined length of each thread, controlling the corresponding thread holding unit to hold the thread; a third control section for, when all the thread holding units hold the threads, controlling the thread cutting unit to cut the threads; and a fourth control section for, after the threads are cut, controlling the thread holding unit which is holding the looper thread to feed the looper thread in the second predetermined length.

* * * * *

UNITED STATES PATENT AND TRADEMARK OFFICE

CERTIFICATE OF CORRECTION

PATENT NO. : 5,138,961

DATED : August 18, 1992

INVENTOR(S) : Minoru Nakano et al.

It is certified that error appears in the above-identified patent and that said Letters Patent is hereby corrected as shown below:

Col. 8,
Claim 1, Line 17, change "length different" to --different length--.

Signed and Sealed this

Fifth Day of October, 1993

*Attest:*

*Attesting Officer*

BRUCE LEHMAN

*Commissioner of Patents and Trademarks*